US007218066B2

(12) United States Patent
Van Casteren

(10) Patent No.: US 7,218,066 B2
(45) Date of Patent: May 15, 2007

(54) DRIVER FOR A GAS DISCHARGE LAMP

(75) Inventor: Dolf Henricus Jozef Van Casteren, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/521,865

(22) PCT Filed: Jul. 1, 2003

(86) PCT No.: PCT/IB03/03013

§ 371 (c)(1),
(2), (4) Date: Jan. 21, 2005

(87) PCT Pub. No.: WO2004/010742

PCT Pub. Date: Jan. 29, 2004

(65) Prior Publication Data

US 2005/0269969 A1 Dec. 8, 2005

(30) Foreign Application Priority Data

Jul. 22, 2002 (EP) ..... 02077984

(51) Int. Cl.
*H05B 37/02* (2006.01)

(52) U.S. Cl. ..... 315/307; 315/224; 315/DIG. 7

(58) Field of Classification Search ..... 315/291, 315/224, 307, 219, DIG. 7, 209 R
See application file for complete search history.

(56) References Cited

U.S. PATENT DOCUMENTS

| | | | | |
|---|---|---|---|---|
| 5,291,101 | A * | 3/1994 | Chandrasekaran | 315/DIG. 7 |
| 5,917,290 | A | 6/1999 | Shen et al. | 315/209 R |
| 5,932,976 | A | 8/1999 | Maheshwari et al. | 315/291 |
| 5,973,437 | A * | 10/1999 | Gradzki et al. | 315/219 |
| 6,069,458 | A * | 5/2000 | Takehara et al. | 315/224 |
| 6,577,078 | B2 * | 6/2003 | Shen | 315/307 |

* cited by examiner

*Primary Examiner*—Tuyet Vo
*Assistant Examiner*—Ephrem Alemu

(57) ABSTRACT

Driver (150) for a gas discharge lamp (9) comprises: an arrangement of two MOSFET switches (61, 62) connected in series between two input terminals (51*a*, 52*b*); an inductor (73) connected in series with said lamp (9), this series arrangement being coupled to a node (P) between said two switches; a control unit (180) providing control signals (S1, S2) to said two switches. During a first commutation interval (41), a lamp circuit current (ILC) has only a first direction while during a second commutation interval (42) said lamp circuit current has only an opposite direction. In each commutation interval (41, 42), during a first operational phase (43) said lamp circuit current has a continuously increasing level while during a second operational phase (44) said lamp circuit current has a continuously decreasing level. The control unit (180) is designed to generate its control signals (S1, S2) such that said two switches are always, switched substantially simultaneously in counter-phase. The mosfets are used in reverse conduction m node also, to avoid body diode conduction (synchronous rectification).

10 Claims, 9 Drawing Sheets

DRIVER FOR A GAS DISCHARGE LAMP

The present invention relates in general to drivers for gas discharge lamps. As is commonly known, a driver for a gas discharge lamp serves to feed the gas discharge lamp with the required amount of current, and receives power itself from AC mains. Conventionally, such a driver comprises three stages: a rectifier and upconverter for converting the AC input voltage to a higher DC output voltage, a downconverter for converting said DC voltage to a lower voltage but higher current, and finally a commutator switching the DC current for the lamp at a relatively low frequency. In a more recent design, the last two stages (i.e. downconverter and commutator) have been integrated into a single stage, referred to as forward commutating stage. Such an integrated stage offers advantages, such as fewer components and a smaller size.

In such a forward commutating stage, one can distinguish between a half-bridge type and a full-bridge type. However, such a forward commutating stage always has at least one chain of two series-connected MOSFET switches, wherein the gas discharge lamp to be driven is connected to the node between said two switches.

During steady state operation, the lamp current in principle has a substantially constant magnitude, but the lamp current changes direction at regular intervals. A full lamp period comprises a first time interval where the lamp current has one direction, and a second time interval where the lamp current has the reverse direction. During each of these intervals, one of said two chain switches is active, while the other is passive. Conventionally, the active switch is switched open (non-conductive state) and closed (conductive state) at a relatively high frequency. During the closed condition of this active switch, current for a lamp circuit is conducted by this active switch and increases in magnitude. During the open condition of this active switch, the lamp circuit current is conducted by a diode in parallel with the other switch, i.e. the passive switch. This diode may be the internal body diode of the MOSFET switch itself. However, this internal body diode behaves badly at relatively high frequencies, especially at the transition from the conductive state to the non-conductive state, which causes relatively much loss of energy. In order to improve this switching behavior, it has already been proposed to add two separate diodes for each MOSFET switch, one diode being series-connected and the other being anti-parallel connected. Then, when the active MOSFET is opened, the lamp circuit current is conducted by said anti-parallel diode, while said series-connected diode blocks the current through said passive switch. However, this design involves two additional components for each MOSFET, while additionally the series-connected diode contributes to energy losses when its corresponding MOSFET is the active MOSFET.

It is a general objective of the present invention to provide an improved driver for a gas discharge lamp. Particularly, it is an objective of the present invention to provide an improved forward commutator device for a gas discharge lamp.

In a first aspect, the present invention is based on the recognition that a MOSFET switch can conduct current in two directions. The present invention utilizes this recognition by using the passive MOSFET itself for conducting the lamp circuit current during those moments that the active MOSFET is open.

Conventionally, the active MOSFET is closed (i.e.: switched to its conductive state, also indicated as the ON state) when the decreasing lamp circuit current reaches a first current level, and this active MOSFET is opened (i.e.: switched to its non-conductive state, also indicated as the OFF state) when the increasing lamp circuit current through the active MOSFET reaches a second, higher current level. Conventionally, the first current level is higher than zero. However, it is advantageous if the active MOSFET would be switched ON at approximately zero lamp current, because then switching losses are minimal. This is especially the case when, in accordance with the above-mentioned first aspect of the present invention, the passive MOSFET is switched ON when the active MOSFET is switched OFF. Thus, there is a need for an accurate current sensor which accurately indicates zero-crossings of the lamp circuit current. It is, of course, possible to use a measuring resistor in series with the lamp circuit current and to measure the voltage across this measuring resistor, but this will involve relatively large resistive losses.

Therefore, it is a further objective of the present invention to provide a relatively simple, accurate current sensor which involves relatively little losses.

Ideally, switching takes place when the lamp circuit current is exactly zero. However, generating a detector signal, sending this detecting signal to a control device for the MOSFET switches, and switching the MOSFET switches, causes a time delay between the moment of detection and the moment of actual switching. Therefore, it is a further objective to provide a zero crossing detector which can already provide a sensor signal shortly before the actual zero crossing.

In accordance with a second aspect of the present invention, a zero-crossing current detector comprises a small transformer having a first transformer winding connected in series with the lamp. The small transformer is already saturated at relatively small primary currents; then, at the secondary side, no signal will be provided. Only at smaller currents, i.e. around the zero crossings, the transformer is out of saturation and a signal is provided at its secondary winding.

As mentioned above, the lamp current changes direction at regular intervals. This is referred to as the commutation moment. At the commutation moment, the active MOSFET becomes the passive MOSFET, while the passive MOSFET becomes the active MOSFET. In the state of the art, the commutation moment is determined independently of the actual status of the lamp current. This means that the actual commutation moment is at random with respect to the actual current magnitude, which may lead to undesirable lamp behavior. It is a further objective of the present invention to improve lamp behavior by a better control of the commutation moment. According to a further aspect of the present invention, the commutation moment is selected in synchronization with the high frequency switching of the MOSFET switches. More particularly, the commutation moment is selected to substantially coincide with a zero crossing.

These and other aspects, features and advantages of the present invention will be further explained by the following description of a preferred embodiment of a driver according to the present invention with reference to the drawings, in which same reference numerals indicate same or similar parts, and in which:

FIG. 1A schematically illustrates a conventional driver for a gas discharge lamp;

FIG. 1B is a graph illustrating lamp current as a function of time;

FIG. 2 schematically illustrates another conventional driver for a gas discharge lamp;

Figure 7A:
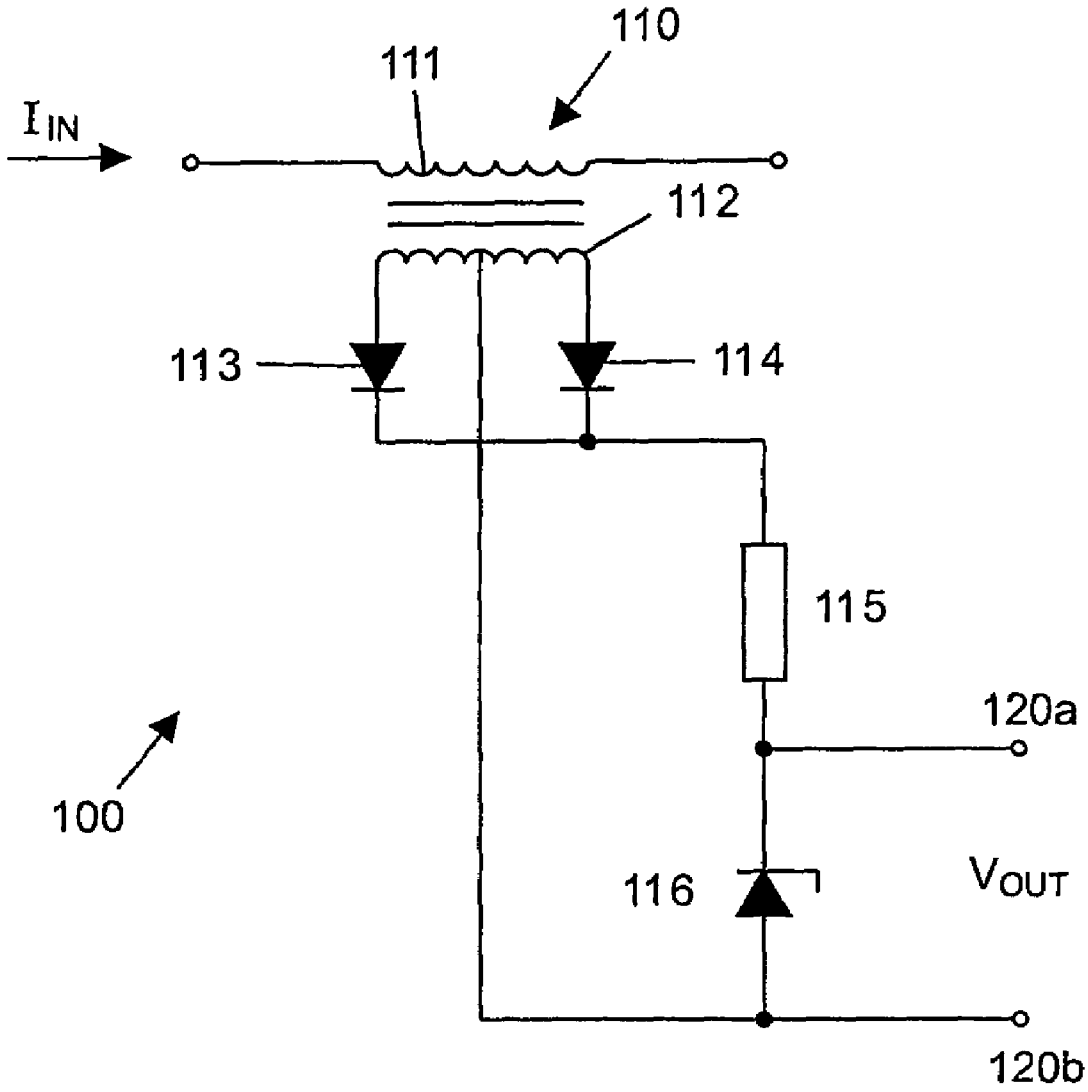
Figure 7B:
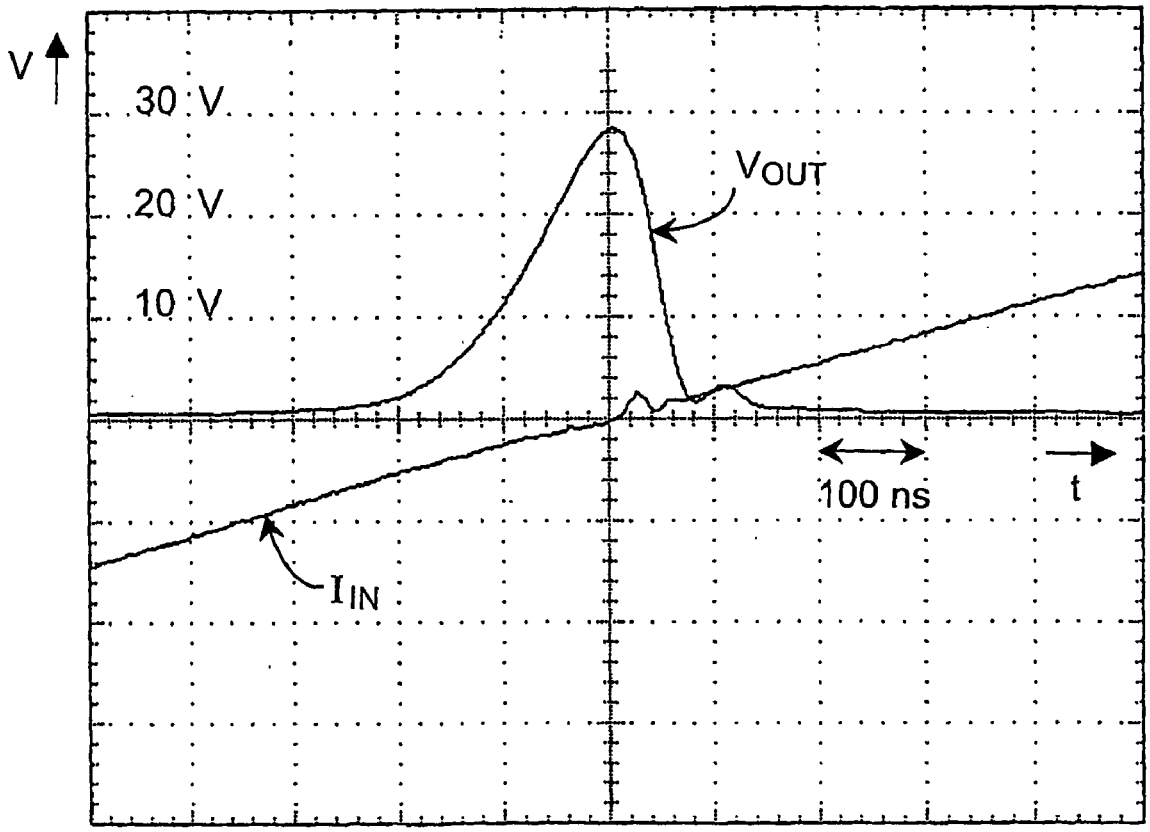
Figure 8:
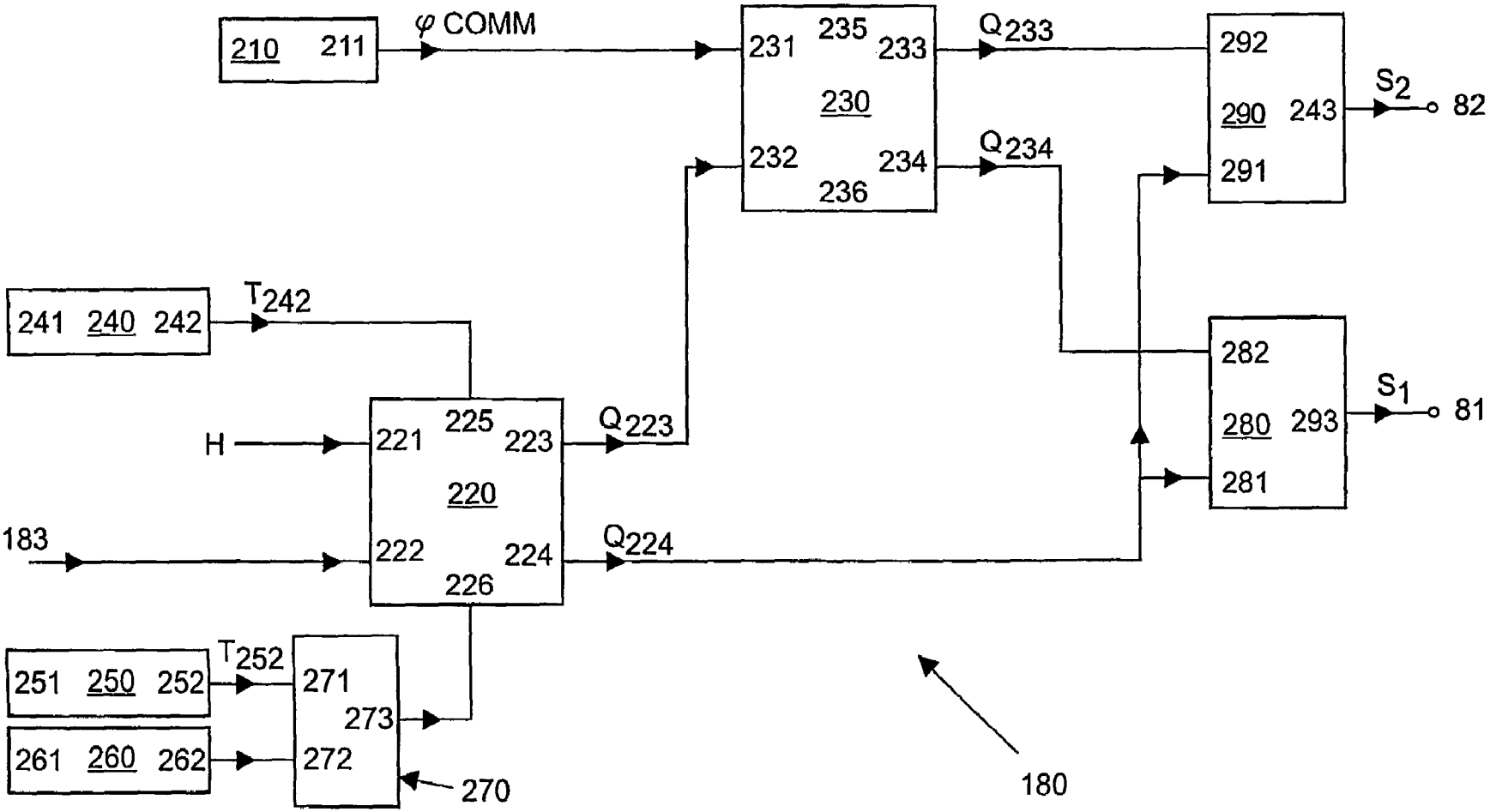
Figure 9:
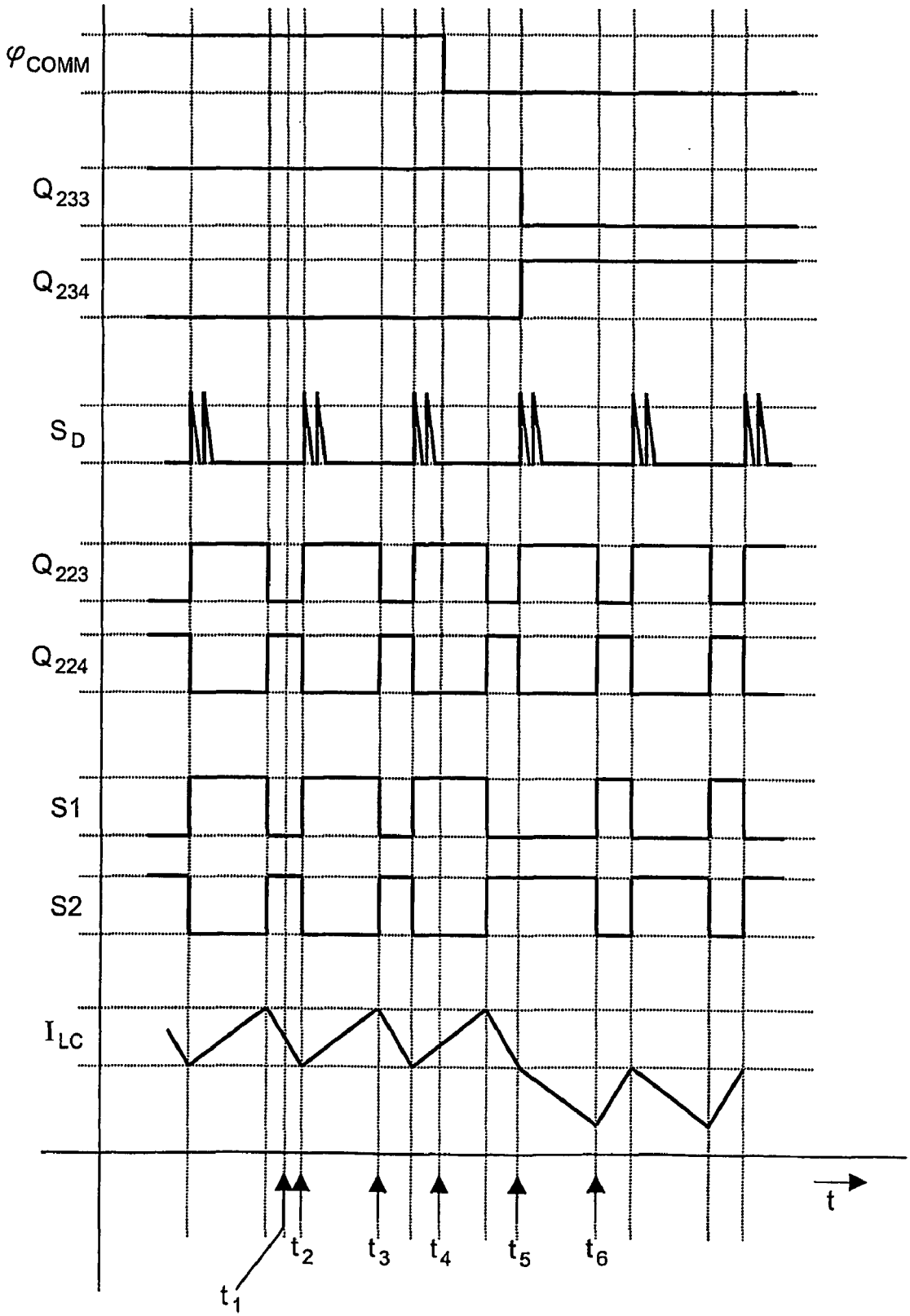

FIG. 7A schematically illustrates a current sensor according to the present invention;

FIG. 7B is a graph illustrating the performance of the current sensor of FIG. 7A;

FIG. 8 is a functional block diagram schematically illustrating an exemplary embodiment of a control unit;

FIG. 9 is a graph showing lamp circuit current as well as several signals as a function of time.

Figure 1A:
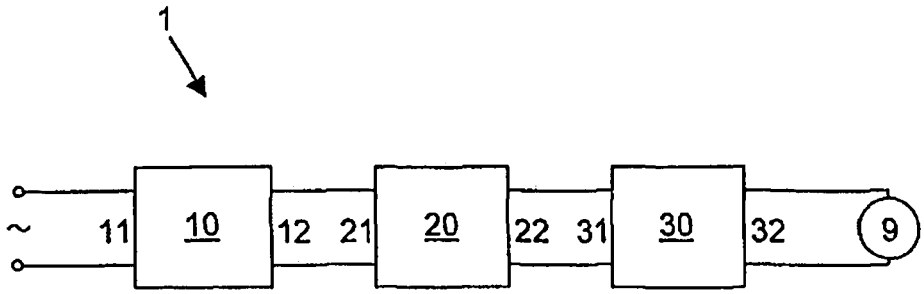
FIG. 1A (PRIOR ART)

FIG. 1A schematically illustrates a conventional driver 1 for a gas discharge lamp 9. The conventional driver 1 comprises a first stage 10, also referred to as preconditioner, having an input 11 for receiving an AC mains voltage, typically in the order of about 230 V. The pre-conditioner 10 comprises rectifying means for rectifying the input voltage, and up-transformer means for transforming the rectified voltage to a higher DC voltage, typically in the order of 400 V or higher. This upconverted DC voltage is provided at an output 12 of the preconditioner 10. Since such preconditioners are commonly known, and the design of such a preconditioner is no subject of the present invention, while a preconditioner that is known per se may be used in the driver according to the present invention, the preconditioner 10 will not be explained here in more detail.

Figure 1B:
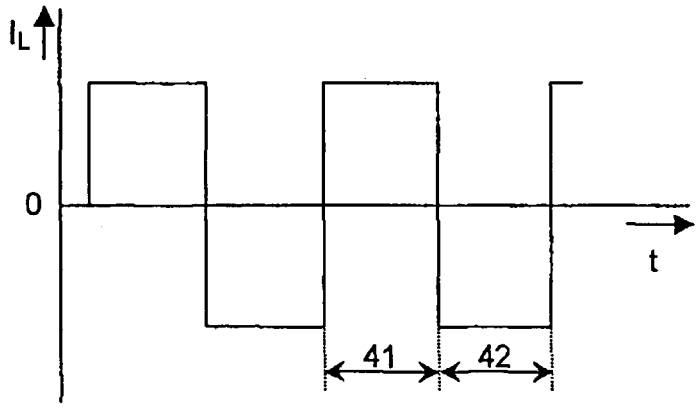
FIG. 1B (PRIOR ART)

A conventional driver has a second stage or downconverter 20, having an input 21 connected to the output 12 of the pre-conditioner 10, and having an output 22 providing a DC output current at a voltage level lower than the output voltage of the pre-conditioner 10. In principle, this DC output current of the downconverter 20 might be provided directly to a lamp 9; however, gas discharge lamps need to be driven in general at an alternating current. For this purpose, conventionally a commutator 30 is present, having an input 31 receiving the DC current generated by the downconverter 20, and providing an alternating DC current at its output 32. FIG. 1B illustrates schematically the shape of the current $I_L$ through the lamp 9 as a function of time t; herein, the superimposed high-frequency ripple components are neglected. During a first commutation interval 41, the lamp current flows in one direction, whereas in a second commutation interval 42 the lamp current has the same magnitude but flows in the opposite direction.

Figure 2:
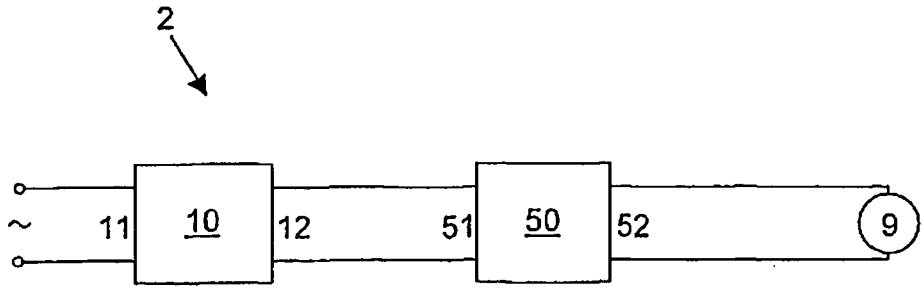
FIG. 2 (PRIOR ART)

FIG. 2 schematically illustrates a commonly known design for a driver 2, in which the two separate stages 20 and 30, i.e. the downconverter 20 and the commutator 30, have been replaced by one single commutating forward device 50, having an input 51 receiving the DC output voltage of the preconditioner 10, and having an output 52 generating an alternating DC current as generally illustrated in FIG. 1B.

Figure 3:
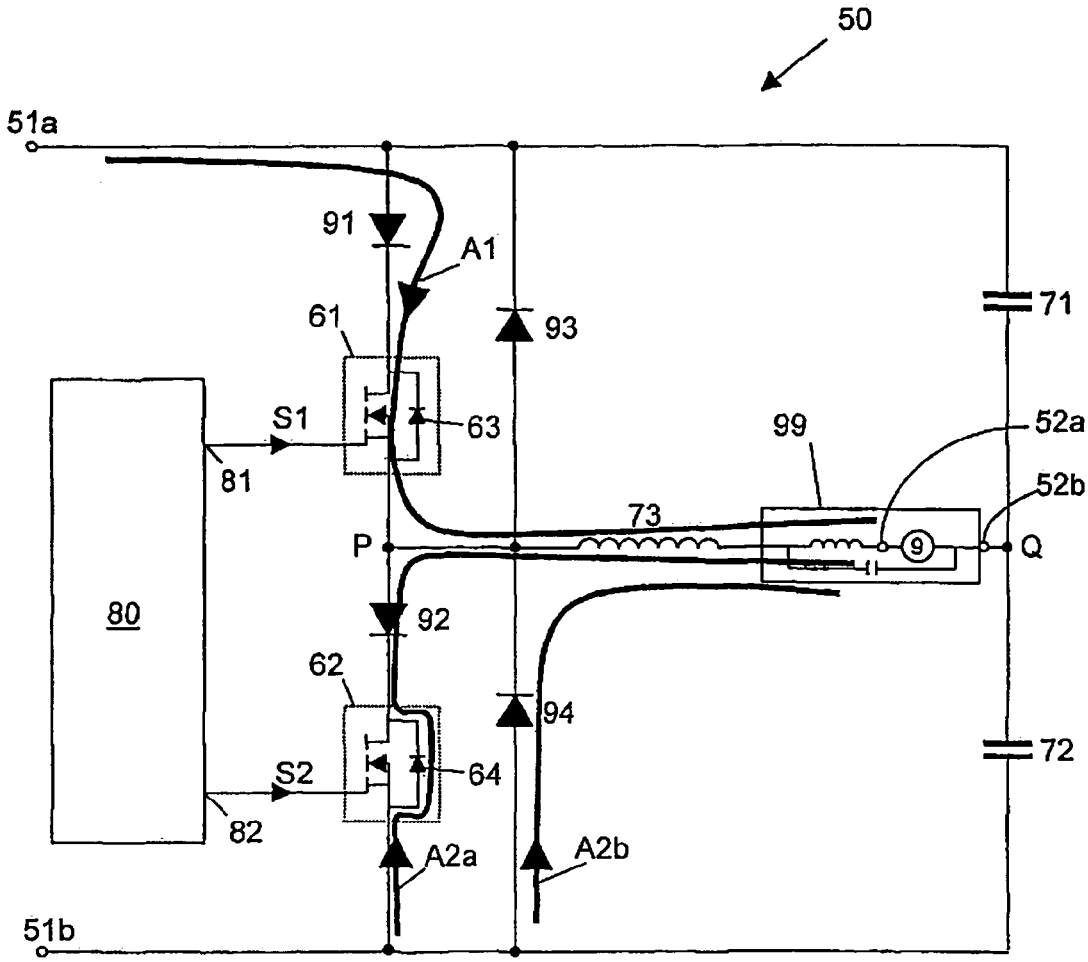
FIG. 3 (PRIOR ART)
FIG. 3 is a block diagram showing a state of the art commutating forward driver in more detail.

FIG. 3 shows the main components of a state of the art commutating forward driver 50 for illustrating the operation thereof. In this example, the commutating forward device 50 is of the half-bridge type; a skilled person will recognize that the following explanation can, mutatis mutandis, be applied also to a commutating forward device of the full-bridge type.

The commutating forward driver 50, hereinafter abbreviated as CFD 50, has two input terminals 51*a* and 51*b* for connection to a preconditioner, the first input terminal 51*a* being maintained at a voltage level higher than the second input terminal 51*b*, the voltage difference typically being about 400 V. Furthermore, the CFD 50 has two output terminals 52*a* and 52*b* for connecting a lamp 9.

A body diode of the MOSFETS 61, 62 is shown at 63, 64, respectively.

The CFD 50 comprises a first MOSFET switch 61 having its source and drain terminals connected between the first input terminal 51*a* and a first node P, and a second MOSFET switch 62 having its source and drain terminals connected between said first node P and the second input terminal 51*b*. The CFD 50 further comprises a first capacitor 71 connected between the first input terminal 51*a* and a second node Q, and a second capacitor 72 connected between this second node Q and the second input terminal 51*b*. Between said two nodes P and Q, a coil 73 is connected in series with a lamp circuit 99. Lamp output terminals are indicated at 52*a* and 52*b*. Said lamp circuit 99 comprises the lamp 9 arranged in series with an ignitor coil, and a filter capacitor arranged in parallel with said series arrangement. Current applied to said lamp circuit 99 will be indicated as lamp circuit current $I_{LC}$. Said ignitor coil and filter capacitor serve to smoothen the current through the lamp 9, indicated as lamp current $I_L$.

Furthermore, the CFD 50 comprises a control unit 80, having a first output 81 coupled to the gate terminal of the first MOSFET 61, and a second output 82 coupled to the gate terminal of the second MOSFET 62. The control unit 80 is designed to open and close the MOSFET switches 61 and 62 by supplying control signal S1 and S2 at its outputs 81 and 82, as will be clear to a person skilled in the art. Hereinafter, a signal S1, S2 causing a corresponding MOSFET switch to close (conductive state; ON) will be indicated as logical value "1", whereas a signal S1, S2 causing a corresponding MOSFET switch to open (non-conductive state; OFF) will be indicated as logical value "0".

Figure 4A:
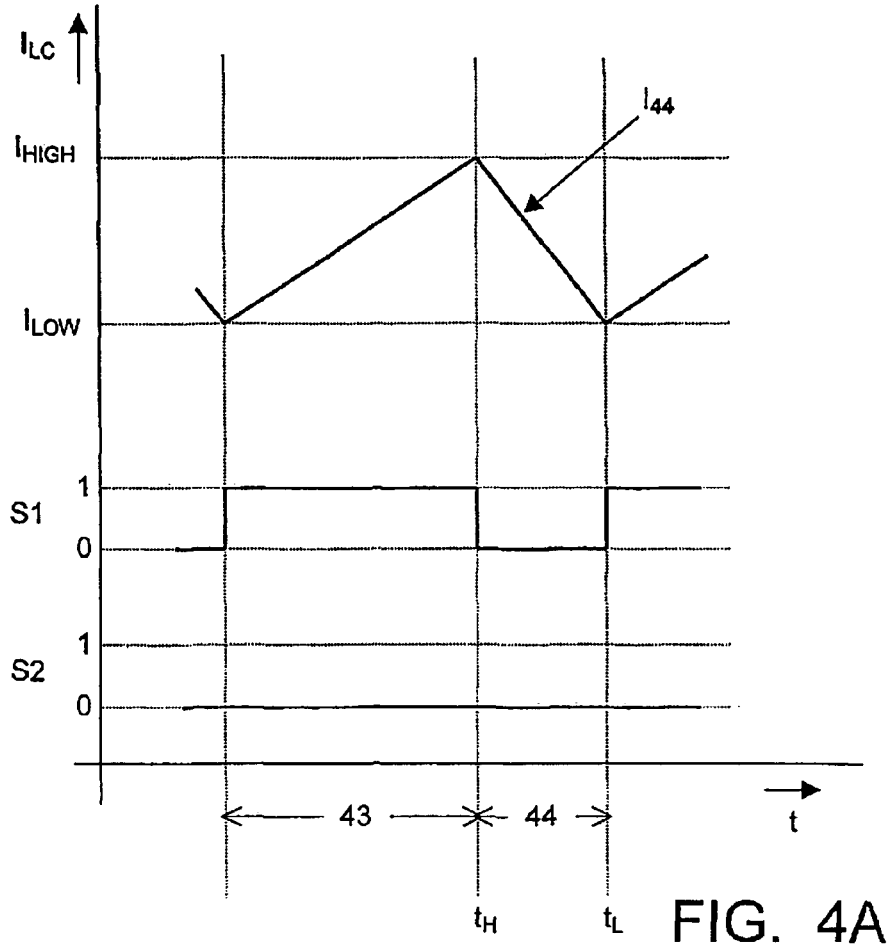
FIG. 4A (PRIOR ART)
FIG. 4A is a timing diagram illustrating lamp circuit current and control signals as a function of time.

The operation of the half-bridge CFD 50 will now be explained, while also referring to FIG. 4A, which shows the conventional control signals S1 and S2 and the lamp circuit current $I_{LC}$ as a function of time t. During the first commutation interval 41 (see FIGS. 1B and 4B), two operational phases 43 and 44 can be distinguished. During a first operational phase 43, which will also be indicated as the main phase 43, the output control signal S1 at the first output terminal 81 of the control unit 80 is such that the first MOSFET 61 is in the conductive state, while the second output control signal S2 at the second output 82 of the control unit 80 is such that the second MOSFET 62 is in the non-conductive state. Then, the lamp circuit current passes from the first input terminal 51*a* through the first MOSFET 61, the lamp coil 73 and the lamp circuit 99, as indicated by a first arrow A1. This lamp current increases in magnitude during this first phase 43, as illustrated in FIG. 4A.

At a certain switching time $t_H$, the control unit 80 changes its first output control signal S1 such that the first MOSFET switches to its non-conductive state. At that moment, the lamp circuit current $I_{LC}$ has a certain magnitude, indicated as $I_{HIGH}$ in FIG. 4A. The second control output signal S2 is maintained, such that the second MOSFET 62 remains in its non-conductive state. The lamp coil 73, which can be considered as being charged with magnetic energy, now provides for a continuation of the lamp circuit current in the same direction, albeit at a decreasing current magnitude. This current cannot flow from the first input terminal 51*a*, but flows from the second input terminal 51*b* through the lamp coil 73 and the lamp 9. Hereinafter, this current will also be indicated as coil-driven current $I_{44}$.

At a later moment in time, indicated as $t_L$ in FIG. 4A, the control unit 80 again changes its first output control signal S1 such that the first MOSFET 61 is again switched to its conductive state. At that moment, the lamp circuit current has reached a current level $I_{LOW}$ lower than the first level $I_{HIGH}$. The second operational phase 44 between $t_H$ and $t_L$, during which the lamp circuit current is coil-driven and decreases from first current level $I_{HIGH}$ to second current level $I_{LOW}$, will also be indicated as coil-driven phase 44.

The first switch 61, which conducts the lamp circuit current during the main phase 43, will also be indicated as the active switch. The other switch 62 will be indicated as passive switch.

In the state of the art, during the first interval, the first switch 61 or active switch 61 is repeatedly switched on and off, while the passive switch 62 remains switched off. In one possible embodiment of the state of the art CFD 50, the coil-driven current $I_{44}$ flows through the second body diode 64 of the passive second MOSFET 62, as indicated in FIG. 3 by arrow A2*a*.

In another possible embodiment of the prior art CFD 50, a first external diode 91 is connected in series with the first MOSFET 61, its anode being coupled to the first input terminal 51*a* and its cathode being coupled to the MOSFET 61. Similarly, a second diode 92 is connected in series with the second MOSFET 62. A third external diode 93 is connected between the first input terminal 51*a* and the first node P, its cathode being connected to first input terminal 51*a* and its anode being connected to first node P. Similarly, a fourth external diode 94 is connected between first node P and second input terminal 51*b*. In such an embodiment, the second diode 92 prevents the flow of coil-driven current through second body diode 64, and the coil-driven current $I_{44}$ now flows through fourth diode 94, as indicated by arrow A2*b*.

As discussed in the introduction, both prior art solutions have disadvantages.

To complete the description of the operation of CFD 50, the switching of first MOSFET 61 is repeated continuously until a commutation moment. At such a moment, the first commutation interval 41 ends and the second commutation interval 42 starts (see FIGS. 1B and 4B). During the second interval 42, the second MOSFET 62 is repeatedly switched on and off while the first MOSFET 61 is maintained in its off state. It will be clear to a person skilled in the art that now the lamp circuit current flows in the opposite direction through the lamp circuit 99, and rises during a main phase or active phase from a low current magnitude to a high current magnitude and decreases in a coil-driven phase from the high magnitude to the lower magnitude. During the main phase or active phase 43, the current is conducted by the second MOSFET 62, while in the coil-driven phase 44, the current passes through the first body diode 63 of the first MOSFET 61 or, alternatively, through the third separate diode 93 parallel to said first MOSFET 61.

Figure 4B:
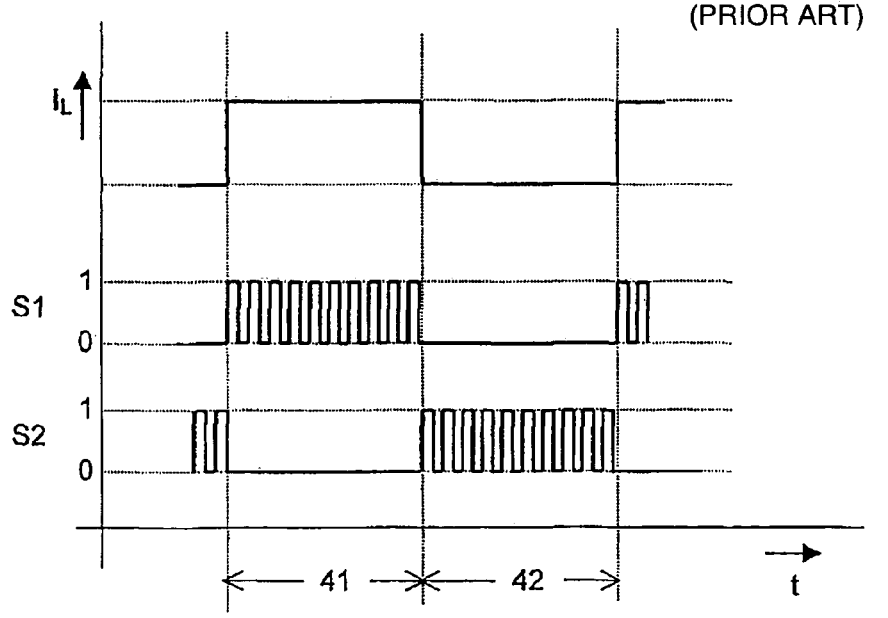
FIG. 4B (PRIOR ART)
FIG. 4B is a timing diagram illustrating lamp current and control signals as a function of time, on a different scale.

FIG. 4B is a timing diagram of the control output signals of the control unit 80 in relation to the intervals 41 and 42 of FIG. 1B, according to the state of the art.

Figure 5:
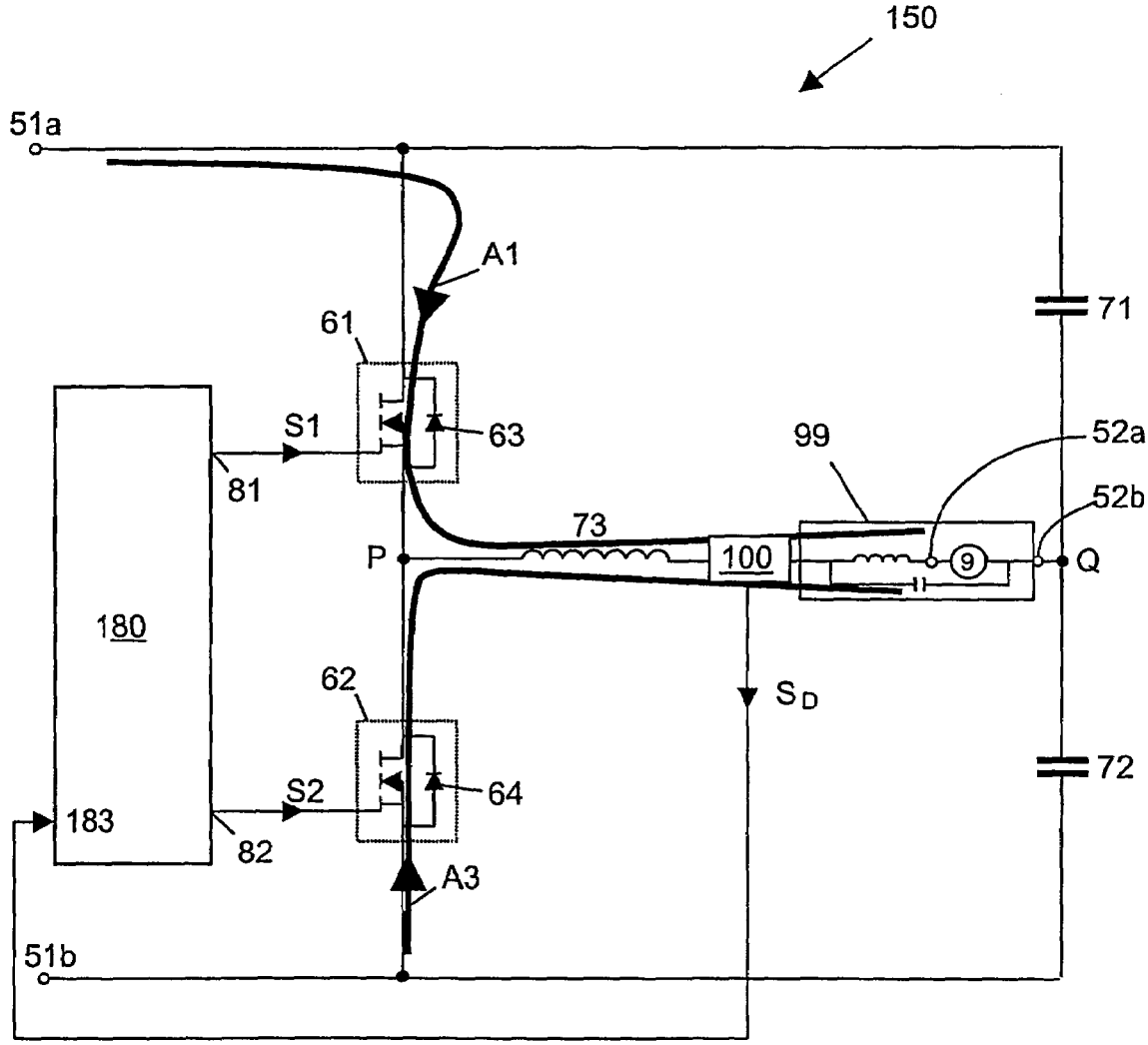
FIG. 5 is a schematic circuit diagram of a driver according to the present invention.

FIG. 5 is a schematic circuit diagram of a CFD 150 according to the present invention, comparable to FIG. 3. As can be seen, the separate diodes 91–94 are not present. However, the CFD 150 according to the present invention does not have the above-mentioned disadvantages of the prior art as regards the body diodes 63 and 64. As mentioned above, in the coil-driven circuit according to the prior art bypasses current the body diode of the passive MOSFET (arrow A2*a* in FIG. 3). According to the present invention, however, while the main current flows through the active switch 61 during the main phase 43, as indicated by arrow A1 in FIG. 5, the coil-driven current $I_{44}$ flows through the channel of the passive second MOSFET 62 during the coil-driven phase 44, as indicated by arrow A3 in FIG. 5.

Figure 6:
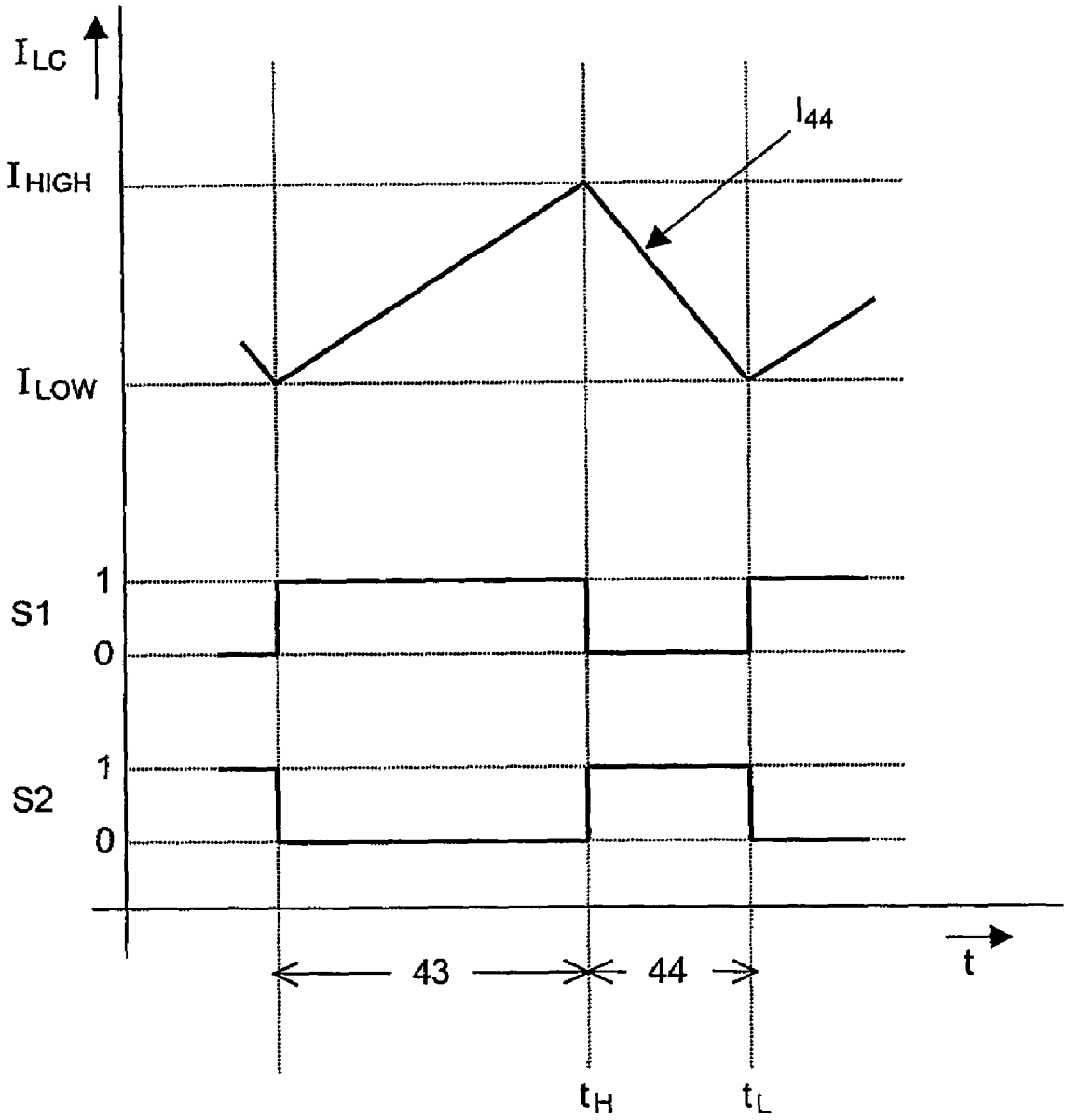
FIG. 6 is a timing diagram, comparable to FIG. 4A, illustrating the lamp circuit current and driver control signals as a function of time for the driver according to the present invention.

FIG. 6 is a graph, comparable to FIG. 4A, illustrating the command output signals S1 and S2 of a control unit 180 according to the present invention, as well as the resulting circuit current $I_{LC}$ through the lamp circuit 99, as a function of time. When comparing FIG. 6 with FIG. 4A, it will be clear that the timing of the control output signal S1, S2 for the active MOSFET, i.e. These first MOSFET 61 during the first commutation interval 41 and the second MOSFET 62 during the second commutation interval 42, is the same as in the state of the art. However, in contrast to the state of the art, the passive switch is also switched on and off in counter-phase with the switching of the active switch.

It is noted that this timing as illustrated in FIG. 6 seems similar to the timing of a synchronic inverter. However, in the case of an inverter, the current through each switch is always directed from drain to source. This means that, if the circuit were driven as an inverter, the control signal S1 would be high during the first commutation interval and the second control signal S2 would be low during the same commutation interval, resulting in a current in the direction from node P to node Q, this current flowing through first switch 61 from its drain terminal to its source terminal, while in the second commutation interval, the first control signal S1 would be low and the second control signal S2 would be high, resulting in a current from node Q to node P, which would flow through the second switch from its drain to its source. However, in the present invention, during the coil-driven phase 44 of the first commutation interval 41, when the first control signal S1 is low and the second control signal S2 is high, the current is still in the direction from node P to node Q, thus flowing through the second MOSFET 62 from its source to its drain.

An important advantage obtained by using the low-resistive MOSFET channel for conducting current from source to drain is the fact that switching of the MOSFET is much faster than switching of its body diode. Specifically, the MOSFET can be switched off much faster than its body diode, or much faster than any other diode for that matter, so reversed recovery losses are eliminated.

The switching principle proposed by the present invention, based on the use of the MOSFET channel from source to drain, can already be used in principle if the second or lower current level $I_{LOW}$ has an arbitrary value above zero. However, full advantage of the inventive idea is achieved if the lower current level $I_{LOW}$ is equal to zero. This mode of operating a gas discharge lamp is indicated as critical discontinuous mode. In order to be able to accurately switch when the lamp current is close to zero, the inventive CFD 150 preferably comprises a current sensor 100, as illustrated in FIG. 5, which senses the lamp circuit current and sends a detector signal SD to a sensor input 183 of the control unit 180, the sensor signal $S_D$ being indicative of a zero crossing.

FIG. 7A illustrates a preferred embodiment of such a current sensor 100. Important advantages of this preferred embodiment are the small size, the low number of components, and the low cost.

The preferred embodiment of a current sensor 100 proposed by the present invention and as illustrated in FIG. 7A comprises a small transformer 110 having a primary winding 111 and a secondary winding 112. The primary winding 111 is connected in series with the lamp circuit 99 between the nodes P and Q, so that the full lamp circuit current $I_{LC}$ passes through this first winding 111. In FIG. 5, the primary winding 111 is connected in series between the coil 73 and the lamp 9. A first diode 113 has its anode connected to a first end of the secondary winding 112, and a second diode 114 has its anode connected to the other end of the secondary winding 112. The cathodes of these two diodes 113 and 114 are connected together and to a first terminal of a resistor 115, the other terminal of said resistor being connected to a first output terminal 120*a* of the current sensor 100. A second output terminal 120*b* of the current sensor 100 is connected to a central terminal of the secondary winding 112.

The transformer 110, preferably of the toroidal type, is very small, so that its core is saturated even at a relatively small current through its primary winding 111. In such a saturated condition, an increase or decrease of the lamp current through primary winding 111 will not result in a change of magnetic flux within this core, and therefore will not result in any current in the secondary winding 112. However, as soon as the current through the primary winding 111 approaches zero, the transformer 110 comes out of saturation and is capable of generating a voltage peak between the two ends of its secondary winding 112. Depending on the sign of this voltage peak with reference to the central terminal and therefore with reference to the second output terminal 120*b*, the first diode 113 or the second diode 114 directs this voltage peak via the resistor 115 to the first output terminal 120*a*. Preferably, a zener diode 116 is connected between the two output terminals 120*a* and 120*b*, clamping the voltage level of the output pulse to a desired logical value and thus preventing that the voltage at the first output terminal 120*a* can rise too high.

FIG. 7B illustrates the result of a measurement performed with the current sensor 100 illustrated in FIG. 7A. As a suitable example of a small transformer 110, a standard ferrite ring core was used, having a diameter of 4 mm and a height of 1.6 mm (i.e. size RLC 4/1.6), made from PHILIPS 3E5 (which is a high permeability MnZn grade material). The primary winding 111 had 10 turns, while the secondary winding 112 had 2 turns. The saturation level was approximately 200 mA.

During this experiment, a current source was connected to the primary winding 111, the current through the primary winding 111 being indicated as input current $I_{IN}$ in FIG. 7A. This input current $I_{IN}$ was made to pass zero at a rate of 2.7 A/μs. FIG. 7B clearly shows that the current sensor 100 provides at its secondary winding 112 a substantial voltage output pulse $V_{OUT}$ having a peak value of about 28 V, which peak substantially coincides with the actual zero crossing of the input current $I_{IN}$ in the primary winding 111. It also clearly shows that the rising edge of this voltage pulse is located in the order of about 100 ns before said actual zero crossing. Thus, if the input 183 of the control unit 180 is designed to respond to the rising flank of the sensor signal $S_D$, i.e. that the control unit 180 is triggered by the rising edge of a pulse, the actual moment of switching the MOSFETS 61 and 62 can accurately coincide with the actual zero crossing of the lamp current $I_L$.

It is noted that the actual width of the voltage pulse depends, inter alia, on the specific design of the transformer 110. This allows a designer to design the properties of the transformer to suit the requirements of the driver concerned, as will be clear to a person skilled in the art.

It is noted that the switching at time $t_H$ from increasing current to decreasing current can be triggered by the current reaching a predetermined current level. Preferably, however, this switching is time-based, in that the first operation phase or main phase 43 has a predetermined duration $t_{43}$.

A further aspect of the present invention relates to the commutation moments, i.e. These transition from first commutation phase 41 to second commutation phase 42 and vice versa in FIG. 1B. Conventionally, these commutation moments are defined by some clock signal, which defines the duration of the first commutation phase 41 and the second commutation phase 42. As soon as this clock signal indicates that the first commutation phase 41 or the second commutation phase 42, respectively, has ended, the control unit switches its operation to second commutation phase and first commutation phase, respectively. A disadvantage of the conventional drivers in this respect is that the commutation moments have no correlation with the phase of the lamp current $I_L$, so that normally the commutation moments occur at a moment when the lamp circuit current $I_{LC}$ has a finite value between $I_{LOW}$ and $I_{HIGH}$. This fact causes switching losses.

A further objective of the present invention is to also overcome this drawback.

To this end, the control unit 180 of the inventive driver 150 preferably is designed to synchronize commutation with zero crossings of the lamp circuit current $I_{LC}$, i.e. to switch operation from first phase to second phase and vice versa at a moment coinciding with a zero crossing of the lamp circuit current $I_{LC}$.

An exemplary embodiment of a control unit 180 which provides all the above-mentioned advantages is schematically illustrated in FIG. 8 by way of example; other designs providing the same functionality are possible as well.

The design and operation of this exemplary embodiment will now be explained with reference to FIG. 8, and with further reference to FIG. 9, which is a graph showing lamp circuit current as well as several signals as a function of time as occurring in this exemplary embodiment of control unit 180.

The control unit 180 comprises a commutation clock generator 210, having an output 211, providing a square-wave commutation clock signal $\phi_{COMM}$ indicating the commutation phases of the lamp current. Typically, the square-wave signal $\phi_{COMM}$ has a frequency in the order of about 100 Hz. Alternatively, the control unit 180 may have a clock input terminal (not shown) to receive a commutation clock signal from an external commutation clock generator (not shown).

Since clock generator devices are commonly known, and a conventional clock generator device may be used in implementing the control unit of the present invention, it is not necessary here to discuss the design and operation of such a device in more detail.

The control unit 180 further comprises a first D-type flip-flop device 220, having a signal input 221, a trigger input 222, a set input 225, a reset input 226, a first output 223 providing a first output signal $Q_{223}$, and a second output 224 providing a second output signal $Q_{224}$. Furthermore, the control unit 180 comprises a second D-type flip-flop device 230, having a signal input 231, a trigger input 232, a set input 235, a reset input 236, a first output 233 providing a first output signal $Q_{233}$, and a second output 234 providing a second output signal $Q_{234}$.

Each flip-flop device 220, 230 has two operative states: in a first operative state, which will be indicated as the H-state, the first output signal $Q_{223}$, $Q_{233}$ is logical HIGH while the second output signal $Q_{224}$, $Q_{234}$ is logical LOW, whereas in a second operative state, which will be indicated as the L-state, the first output signal $Q_{223}$, $Q_{233}$ is logical LOW while the second output signal $Q_{224}$, $Q_{234}$ is logical HIGH. Each flip-flop device 220, 230 is designed to operate as follows. As long as the set and reset inputs are both LOW, the operative state is maintained until a trigger signal is received at the trigger input. If a trigger signal is received at the trigger input, an operative state will be set such that the first output takes the logical value of an input signal which is received at that moment at the signal input.

Since flip-flop devices are commonly known, and a conventional flip-flop device may be used in implementing the control unit of the present invention, it is not necessary here to discuss the design and operation of such device in more detail.

The control unit 180 further comprises a first timer device 240, having a trigger input 241 and an output 242 providing a first timer output signal $T_{242}$. Furthermore, the control unit 180 comprises a second timer device 250, having a trigger input 251 and an output 252 providing a second timer output signal $T_{252}$. Each timer device has two operative states: in a first operative state, which will be indicated as the L-state, the timer output signal is LOW, whereas in a second operative state, which will be indicated as the H-state, the timer output signal is HIGH. Each timer device is designed to operate as follows. Normally, each timer device is in its L-state. Each timer device, in response to a trigger signal received at its trigger input, waits a predetermined timer period, and then issues a brief HIGH-pulse at its output. The duration of said predetermined timer period has a predetermined value.

Since timer devices are commonly known, and conventional timer devices may be used in implementing the control unit of the present invention, it is not necessary here to discuss the design and operation of such device in more detail.

The control unit 180 further comprises preferably, as shown, a current level detector 260 having an input 261 and an output 262 for providing a current intensity detector signal. The current detector 260 is designed for sensing the lamp current intensity, and for comparing the sensed lamp current intensity with a predetermined high-level threshold. As long as the lamp current intensity is below said predetermined high-level threshold, the current detector 260 is in a first operative state, which will be indicated as the L-state, wherein the current intensity detector signal is LOW. If the lamp current intensity rises above said predetermined high-level threshold, the current detector 260 enters a second operative state, which will be indicated as the H-state, wherein the current intensity detector signal is HIGH.

Since current level detectors are commonly known, and a conventional current level detector may be used in implementing the control unit of the present invention, it is not necessary here to discuss the design and operation of such a current level detector in more detail.

The control unit 180 further comprises a first XNOR device 280 having a first input 281, a second input 282, and an output 283 providing a first control output signal S1, as well as a second XNOR device 290 having a first input 291, a second input 292, and an output 293 providing a second control output signal S2. Each XNOR device has two operative states: in a first operative state, which will be indicated as the L-state, the corresponding output signal S1, S2 is LOW, whereas in a second operative state, which will be indicated as the H-state, the corresponding output signal S1, S2 is HIGH. Each XNOR device is designed to be in its L-state if and when the input signals received at its two inputs have mutually different logical values, and to be in its H-state if and when the input signals received at its two inputs have mutually the same logical value.

Since XNOR devices are commonly known, and a conventional XNOR device may be used in implementing the control unit of the present invention, it is not necessary here to discuss the design and operation of such device in more detail.

Basically, the first flip-flop 220 determines the transition moments $t_H$ and $t_L$ between the first operational phase 43 and the second operational phase 44. If the first flip-flop 220 is in its H-state, the driver 150 is in its first operational phase 43 (FIG. 6); if the first flip-flop 220 is in its L-state, the driver 150 is in its second operational phase 44. As mentioned before, the first output signal S1 should be HIGH during the first operational phase 43 of the first commutation interval 41 but LOW during the first operational phase 43 of the second commutation interval 42. To this end, an output signal $Q_{224}$ of the first flip-flop 220 is XNOR-ed with the commutation clock signal $\phi_{COMM}$.

The first flip-flop 220 enters its H-state at a zero crossing of the lamp current or when a predetermined maximum duration of the L-state has passed, whichever happens first, whereas the first flip-flop 220 enters its L-state at a high level crossing of the lamp current or when a predetermined maximum duration of the H-state has passed, whichever happens first.

In order to assure that the first flip-flop 220 enters its H-state whenever the lamp current crosses zero, the signal input 221 of the first flip-flop 220 is connected to a constant HIGH level source. The trigger input 222 of the first flip-flop 220 is connected to the sensor input 183 of the control unit 180, and thus receives the output signal of the current sensor 100.

The first operational phase 43 may end after a predetermined time, as determined by the second timer 250, or when the lamp circuit current reaches a predetermined current level. The second timer 250 is responsive to the start of the first operational phase 43, and issues a signal pulse at a predetermined time after the start of the first operational phase 43 if by then the circuit current has not reached said predetermined current level yet. The output 252 of the second timer 250 is connected to a first input 271 of an OR gate 270 whose output 273 is connected to the reset input 226 of the first flip-flop 220. Thus, when the second timer 250 emits its signal pulse, the first flip-flop 220 is reset and enters its L-state (moment $t_H$).

The current level detector 260 senses the lamp circuit current, and its output goes HIGH when the lamp circuit current reaches said predetermined current level before said predetermined time has passed. The output 262 of the current level detector 260 is connected to a second input 272 of said OR gate 270. Thus, when the output 262 of the current level detector 260 goes HIGH, the first flip-flop 220 is reset and enters its L-state (moment $t_H$).

The first timer 240 is responsive to the start of the second operational phase 44, and issues a signal pulse at a predetermined time after the start of the second operational phase 44 if by then the current has not passed zero yet. The output 242 of the first timer 240 is connected to the set input 225 of the first flip-flop 220. Thus, when the first timer 240 emits its signal pulse, the first flip-flop 220 is set and enters its H-state (moment $t_L$).

The first XNOR device 280 has its first input 281 coupled to receive the second output signal $Q_{224}$ of the first flip-flop device 220. The output 283 of the first XNOR device 280 is coupled to the first output 81 of the control unit 180 to provide its output signal S1 as a control signal for the first switch 61. At its second input 282, the first XNOR device 280 receives the commutation signal $\phi_{COMM}$ of the commutation clock generator 210. Thus, said output signal S1 is equal to the second output signal $Q_{224}$ of the first flip-flop device 220, or is inverted, depending on the commutation period. However, the commutation signal $\phi_{COMM}$ is not connected directly to the first XNOR device 280 but via the second flip-flop 230 in order to effect a delay until the current crosses zero.

More particularly, the second flip-flop 230 has its signal input 231 connected to the output 211 of the commutation clock generator 210, and has its trigger input 232 connected to the first output 223 of the first flip-flop 220. Thus, at each transistion from the L-state to the H-state of the first flip-flop 220, which will normally take place at a zero crossing of the lamp current, the second flip-flop 230 will enter a state determined by the status of the commutation clock signal $\phi_{COMM}$.

In accordance with the present invention, the second output signal S2 should always be the opposite of the first output signal S1. This can be effected by inverting the first output signal S1 in order to generate the second output signal S2. However, this may involve a timing delay. Therefore, preferably, and as illustrated in FIG. 8, the second output signal S2 is generated by the second XNOR device 290 which also receives the second output signal $Q_{224}$ of the first flip-flop device 220 at its first input 291, but which receives at its second input 292 the first output signal Q233 of the second flip-flop 230.

It is noted that it is desirable to assure a brief period of dead time, i.e. a period when both signals S1 and S2 are low, between successive switching periods, in order to avoid possible periods that signals S1 and S2 are high, and thus to prevent that switches 61 and 62 would conduct simultaneously. However, normally this functionality is implemented in the final MOSFET driver, and is not shown here.

Reference is now made to FIG. 9.

Let us assume that, initially, the commutation clock signal $\phi_{COMM}$ is logical HIGH, that the first flip-flop device 220 is in its L-state ($Q_{223}$ is LOW, $Q_{224}$ is HIGH), that the second flip-flop device 230 is in its H-state ($Q_{233}$ is HIGH, $Q_{234}$ is LOW), and that the first timer device 250 is in its L-state ($T_{252}$ is LOW). Then, the first output control signal S1 is LOW and the second output control signal S2 is HIGH, and the lamp current $I_L$ decreases (time $t_1$ in FIG. 9).

When the lamp circuit current $I_{LC}$ reaches zero, the detector signal $S_D$ shows a detection peak (time $t_2$). Triggered by this detection peak, the first flip-flop device 220 enters its H-state ($Q_{223}$ becomes HIGH, $Q_{224}$ becomes LOW), so that the first output control signal S1 becomes HIGH and the second output control signal S2 becomes LOW. Thus, as explained earlier, the lamp circuit current $I_{LC}$ rises.

Due to by this rising lamp circuit current $I_{LC}$, the current sensor 100 generates a second detection peak, as illustrated in FIG. 9. However, this will have no effect on the state of the first flip-flop device 220.

If the first timer device 250 detects that the predetermined ON-time has passed, or the current detector 260 detects that the lamp circuit current $I_{LC}$ reaches a predetermined current level, the first flip-flop device 220 is reset to its L-state ($t_3$ in FIG. 9, corresponding to $t_H$ in FIG. 6). First output control signal S1 becomes LOW, second output control signal S2 becomes HIGH, and the lamp circuit current $I_{LC}$ decreases again.

This cycle is repeated for as long as the commutation clock signal $\phi_{COMM}$ is logical HIGH. If we now assume that the commutation clock signal $\phi_{COMM}$ changes from HIGH to LOW, indicating a transition from first commutation phase 41 to second commutation phase 42 in FIG. 4B, at an arbitrary moment when the lamp circuit current $I_{LC}$ is not zero ($t_4$ in FIG. 9). According to an important aspect of the present invention, this change does not immediately lead to a change in the output control signals S1 and S2, because the second flip-flop 230 will remain in its current state until triggered. So, the cycle continues, until the first next moment when the lamp current $I_L$ reaches zero ($t_5$ in FIG. 9).

At that moment, in response to the detector signal $S_D$ received at its trigger input 222, the first flip-flop 220 will enter its H-state so that its first output $Q_{223}$ becomes HIGH, which triggers the second flip-flop 230 to enter its L-state, so that now its first output $Q_{233}$ becomes low and its second output $Q_{234}$ becomes HIGH. As a result, the two input signals of each XNOR device 280, 290 change virtually simultaneously, so that the output signal of each XNOR device 280, 290 will be maintained unchanged. In this case, the first output control signal S1 stays LOW and the second output control signal S2 stays HIGH, and the lamp circuit current $I_{LC}$ continues to decrease, i.e. These current magnitude rises but the direction of the current has now been reversed.

This condition of rising lamp circuit current $I_{LC}$ with reversed direction, again corresponding to the main phase 43 of FIG. 6 but now in conjunction with the second commutation phase 42 of FIG. 4B, is maintained until the first timer device 250 detects that the predetermined ON-time has passed, or until the current detector 260 detects that the lamp circuit current $I_{LC}$ reaches said predetermined current level, whichever happens first, at which moment the first flip-flop device 220 is reset to its L-state, so that the first output control signal S1 becomes HIGH and the second output control signal S2 becomes LOW, and the magnitude of the lamp circuit current $I_{LC}$ decreases again.

Thus, the important advantage is achieved that the actual commutation moment ($t_5$) is delayed with respect to the target commutation moment ($t_4$) as indicated by the commutation clock signal $\phi_{COMM}$, such that the actual commutation moment ($t_5$) substantially coincides with a zero crossing of the lamp circuit current $I_{LC}$.

It should be clear to a person skilled in the art that the present invention is not limited to the exemplary embodiments discussed above, but that various variations and modifications are possible within the protective scope of the invention as defined in the appending claims.

For instance, in the above it has been discussed that in each commutation interval the lamp circuit current varies but continuously has the same direction, i.e. These main operational phase 43 is started before the lamp circuit current $I_{LC}$ reaches zero or, ideally, exactly when the lamp circuit current $I_{LC}$ is equal to zero. However, it may be acceptable to start the main operational phase 43 slightly later, so that the lamp circuit current $I_{LC}$ has passed zero, i.e. effectively has changed direction and in fact its current magnitude is increasing again. In order to take this into account, it will be said that, in the main operational phase 43, the circuit current $I_{LC}$ has a continuously rising level and a substantially constant direction, and that, in the second operational phase 44, the circuit current $I_{LC}$ has a continuously decreasing level and a substantially constant direction.

With reference to FIG. 5, a half-bridge implementation of the driver 150 has been explained. It is, however, also possible to implement the inventive concept in a full-bridge design. In that case, the branches 71 and 72 of the bridge can be considered to be replaced by third and fourth MOSFET switches, also controlled by the control unit 180, to be alternate conductive at the low frequency commutating rate. In that case, such third and fourth MOSFET switches may be controlled by the output signals $Q_{233}$ and $Q_{234}$ of the second flip-flop device 230, so that their switching moment also substantially coincides with a zero crossing of the lamp circuit current $I_{LC}$.

Furthermore, delaying the actual commutation moment so as to make it substantially coincide with a zero crossing of the lamp circuit current $I_{LC}$ has been discussed in conjunction with a preferred embodiment also implementing another important aspect of the present invention, i.e. These simultaneous but opposite driving of the switches 61 and 62. However, delaying the actual commutation moment so as to make it substantially coincide with a zero crossing of the lamp circuit current $I_{LC}$ can also be implemented in a prior art device where only one switch is active and where the "return" current flows through the body diode (64; current A2*a* in FIG. 3) or an additional parallel diode (94; current A2*b* in FIG. 3).

Furthermore, it is noted that in the branch between nodes P and Q, the order of the lamp 9, the inductor 73 and the detector 100 may be chosen as desired.

The invention claimed is:

1. Detector (100) for sensing a current and for generating an output signal ($S_D$) indicative of said current crossing zero, the detector comprising a transformer (110) having a primary winding (111) for receiving the current to be sensed and further comprising a secondary winding (112) inductively coupled to said primary winding (111), the transformer (110) being designed such as to be magnetically saturated already at a very low current saturation level;

a first diode (113) having a first terminal (anode) coupled to a first end terminal of the secondary winding (112);

a second diode (114) having a first terminal (anode) coupled to a second end terminal of the secondary winding (112) and having its second terminal (cathode) connected to the second terminal (cathode) of the first diode (113);

a resistor (115) having one terminal connected to the node between said two diodes (113, 114) and having its other terminal coupled to a central tap of the secondary winding (112).

2. Detector according to claim 1, said current saturation level being in the order of about 200 mA.

3. Detector according to claim 1, further comprising a Zener diode (116) coupled between said resistor (115) and said central tap of the secondary winding (112).

4. Driver (150) for a gas discharge lamp (9), comprising:

two input terminals (51*a*, 52*b*) for connection to a source of substantially DC voltage;

two output terminals (52*a*, 52*b*) for connection to a gas discharge lamp (9);

an arrangement of two controllable switches (61, 62) connected in series between said two input terminals (51*a*, 52*b*);

an inductor (73) connected in series with said two output terminals (52*a*, 52*b*), this series arrangement being coupled to a node (P) between said two switches (61, 62);

a control unit (180) having two control outputs (81, 82) coupled to provide control signals (S1, S2) to said two controllable switches (61, 62);

the control unit (180) being designed to generate its control signals (S1, S2) at relatively low frequency commutation intervals (41, 42) and in relatively high frequency operational phases (43, 44), such that during a first commutation interval (41) a lamp circuit current ($I_{LC}$) has substantially only a first direction while during a second commutation interval (42) the lamp circuit current ($I_{LC}$) has substantially only a second direction opposite to the first direction, and such that during a first operational phase (43) the lamp circuit current ($I_{LC}$) has a substantially continuously increasing level while during a second operational phase (44) the lamp circuit current ($I_{LC}$) has a substantially continuously decreasing level;

the driver further comprising a zero crossing detector (100) according to claim 1, wherein the control unit (180) has an input (183) coupled to receive said detector output signal ($S_D$).

5. Driver according to claim 4 comprising a first triggerable timer device (240) having at least one output (242) coupled to a set input (225) of said first flip-flop device (220) and comprising a second triggerable timer device (250) having at least one output (252) coupled to a reset input (226) of said first flip-flop device (220).

6. Driver according to claim 4, comprising a current detector (260) having at least one output (262) coupled to a reset input (226) of said first flip-flop device (220).

7. Driver according to claim 4 further comprising:

a second XNOR device (290) having a first input (291) coupled to receive a signal ($Q_{224}$) logically identical to the signal received by one input (281) of said first XNOR device (280), having a second input (292) coupled to receive a signal ($Q_{233}$) logically opposite to the signal received by the other input (281) of said first XNOR device (280), and having an output (293) coupled to the second output (82) of the control unit (180).

8. Driver according to claim 4, wherein said primary winding (111) is connected in series with the driver output terminals (52*a*, 52*b*).

9. Driver according to claim 4, comprising:

a first flip-flop device (220) being switched at a relatively high frequency corresponding to the operational phases (43, 44);

a second flip-flop device (230) having a signal input (231) for receiving a commutation clock signal ($\phi_{COMM}$), a trigger input (232) coupled to an output (223) of said first flip-flop device (220), and at least one output (224);

a first XNOR device (280) having a first input (281) coupled to an output (224) of said first flip-flop device (220), having a second input (282) coupled to an output (234) of said second flip-flop device (230), and having an output (283) coupled to the first output (81) of the control unit (180).

10. Driver according to claim 9 wherein a signal input (221) of said first flip-flop device (220) is coupled to receive a constant HIGH signal, and wherein a trigger input (222) of said first flip-flop device (220) is coupled to said input (183) for receiving said detector output signal ($S_D$).

* * * * *